US007165559B1

(12) United States Patent
Goodman

(10) Patent No.: US 7,165,559 B1
(45) Date of Patent: Jan. 23, 2007

(54) COSMETIC MAKEUP KIT

(76) Inventor: Jessica Goodman, 300 S. Beverly Dr., No. 407, Beverly Hills, CA (US) 90212

( * ) Notice: Subject to any disclaimer, the term of this patent is extended or adjusted under 35 U.S.C. 154(b) by 187 days.

(21) Appl. No.: 10/815,898

(22) Filed: Mar. 31, 2004

Related U.S. Application Data

(60) Provisional application No. 60/459,226, filed on Apr. 1, 2003.

(51) Int. Cl.
*A45D 33/24* (2006.01)
*A45D 33/26* (2006.01)
*B65D 69/00* (2006.01)

(52) U.S. Cl. ..... 132/294; 206/58.1

(58) Field of Classification Search ..... 132/293, 132/294–297, 301, 305, 286, 314, 315, 320; 206/581, 823; 434/84, 98, 377; 401/581, 401/823

See application file for complete search history.

(56) References Cited

U.S. PATENT DOCUMENTS 2,061,139 A * 11/1936 Cohen ..... 206/489
4,421,127 A * 12/1983 Geer ..... 132/294
4,826,014 A * 5/1989 Schefer ..... 206/581
4,936,463 A * 6/1990 Tiramani ..... 206/581
5,137,040 A * 8/1992 Iosilevich et al. ..... 132/320
5,382,433 A 1/1995 Pahlck et al.
5,520,203 A 5/1996 Segerstrom
5,813,420 A * 9/1998 Sussman ..... 132/294
6,338,349 B1 1/2002 Robinson et al.
6,631,806 B1 * 10/2003 Jackson ..... 206/581
2004/0040570 A1 * 3/2004 Shih ..... 132/293

* cited by examiner

*Primary Examiner*—John J. Wilson
*Assistant Examiner*—Robyn Doan
(74) *Attorney, Agent, or Firm*—Edward A. Sokolski

(57) ABSTRACT

A cosmetic kit has a backing portion on which there are receptacles for containing cosmetics. Each receptacle contains a cosmetic suitable for use on a different portion of the human face. The receptacles themselves or a mask which overlies the receptacles are in shapes which pictorially represent the portion of the face on which each cosmetic is to be used. Thus the user need merely use the cosmetic in the receptacle pictorially representing the portion of the face on which the cosmetic is to be applied; assuring that the proper cosmetic is used for each portion of the face. The kit may be contained in a carrying case which includes a mirror and a receptacle for cosmetic applicators.

4 Claims, 4 Drawing Sheets

COSMETIC MAKEUP KIT

This application is based on Provisional application No. 60/459,226 filed Apr. 1, 2003.

BACKGROUND OF THE INVENTION

1. Field of the Invention

This Invention relates to an all inclusive cosmetic makeup kit or compact, the nature of its design providing a direct visual guide to those users with questions about the application of makeup to the face.

2. Description of the Related Art

Many cosmetic consumers seek the assistance of a cosmetician or make up artist before choosing and purchasing cosmetics. After proper instruction and the purchase of various cosmetics, consumers are faced with performing their future make up applications. For many, repeating a regimen of make up application is considered quite a difficult task, especially for those individuals who are inexperienced or have difficulty remembering what was demonstrated to them. They often struggle when applying the appropriate cosmetics to the proper portions of their faces. Furthermore, many kits contain an over abundant supply of cosmetics for one portion of the face which is likely to overwhelm individuals or cause them to create unflattering cosmetic combinations. These very same consumers may purchase a variety of individually sold products and become confused at a later time when they are faced with using these products on their own.

In an attempt to facilitate the "do-it-yourself" application of cosmetics, devices have been developed providing a series of pigmented cosmetics mounted in a tray. Different kits are created containing specified items and colors. Individuals choose the kit containing a system of colors that best matches their skin tone. One of such devices and systems is described in U.S. Pat. No. 5,520,203 issued May 28, 1996 to Segerstrom. The above indicated approach still requires some figuring on the part of the user and is not as simple to utilize as to be desired.

SUMMARY OF THE INVENTION

The device and method of the present invention overcomes this shortcoming of the prior art by providing customized cosmetic kits designed to satisfy consumers' individual color and product requirements. This end result is achieved by the unique design and user friendly structure of a kit including the image of a face. Cosmetic products needed for each portion of the user's face are provided in the corresponding portions of the "face kit." Each cosmetic is contained in a separate receptacle for each such face portion, thus supplying all the necessary makeup for an individual's complete makeup requirements. Instructions may be included explaining how the kit, based on its structural design, may be used as an instructional model. Users of the kit need simply to apply product to each portion of their faces by selecting makeup contained in the receptacle corresponding to the face portion pictorially shown in the face kit by an image of a face.

The image of the face in one embodiment has receptacles shaped like each feature of the face formed in a backing portion inside the kit, each of these receptacles containing cosmetic for the corresponding part of the face. In a second embodiment, the kit is designed with a mask-like face image with cut out shapes laid over receptacles containing cosmetic, which may be circular, rectangular, etc. In this embodiment, the cut out shapes mimic parts of the face; for example, eyebrows, eyes, nose, lips and cheeks. Thus, for example, when the user is applying "blush" to her cheeks, she will take cosmetic from the receptacles pictorially identified as the "cheek" receptacles, and similarly for other portions of the face.

DETAILED DESCRIPTION OF THE INVENTION

Figure 1:
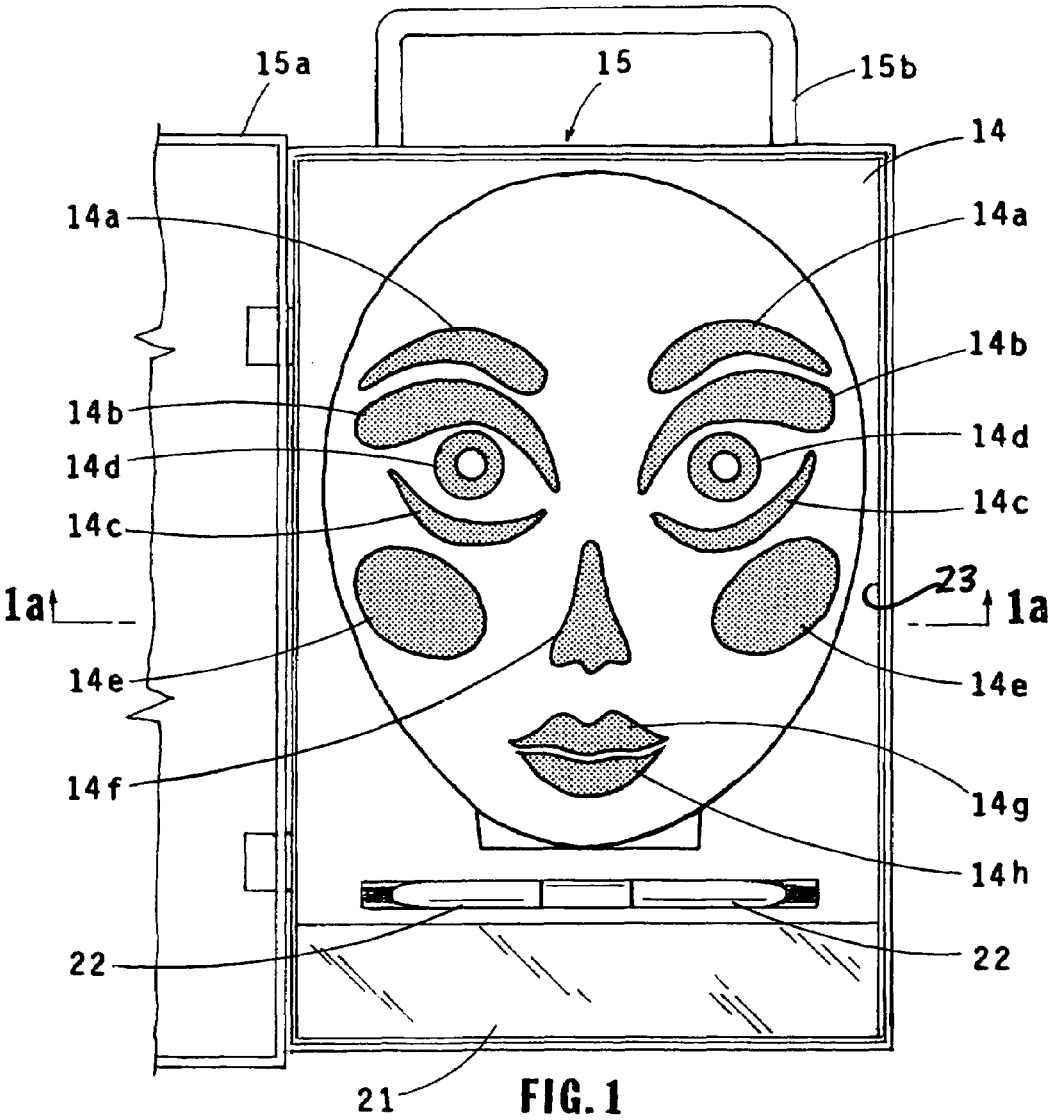
FIG. 1 is front plan view of a first embodiment of the invention.
Figure 1A:
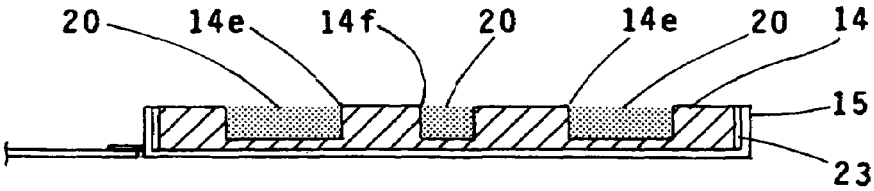
FIG. 1A is a cross-sectional view along the plane indicated by 1A-!A in FIG. 1.
Figure 2:
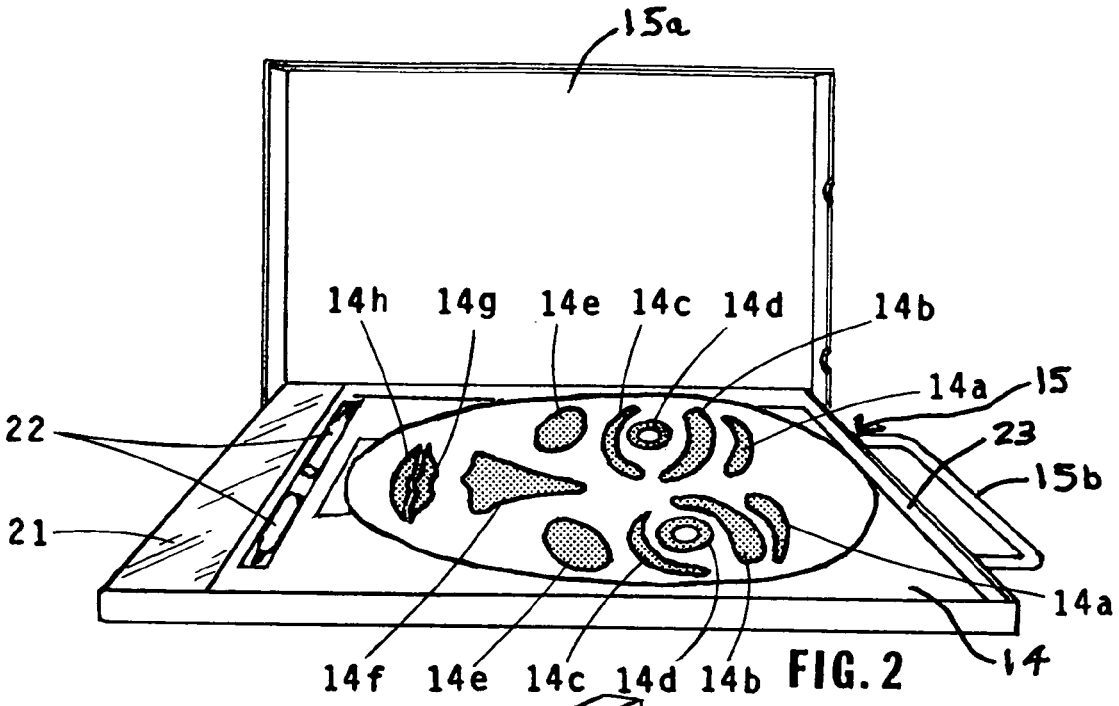
FIG. 2 is a top side perspective view of the embodiment of FIG. 1.
Figure 3:
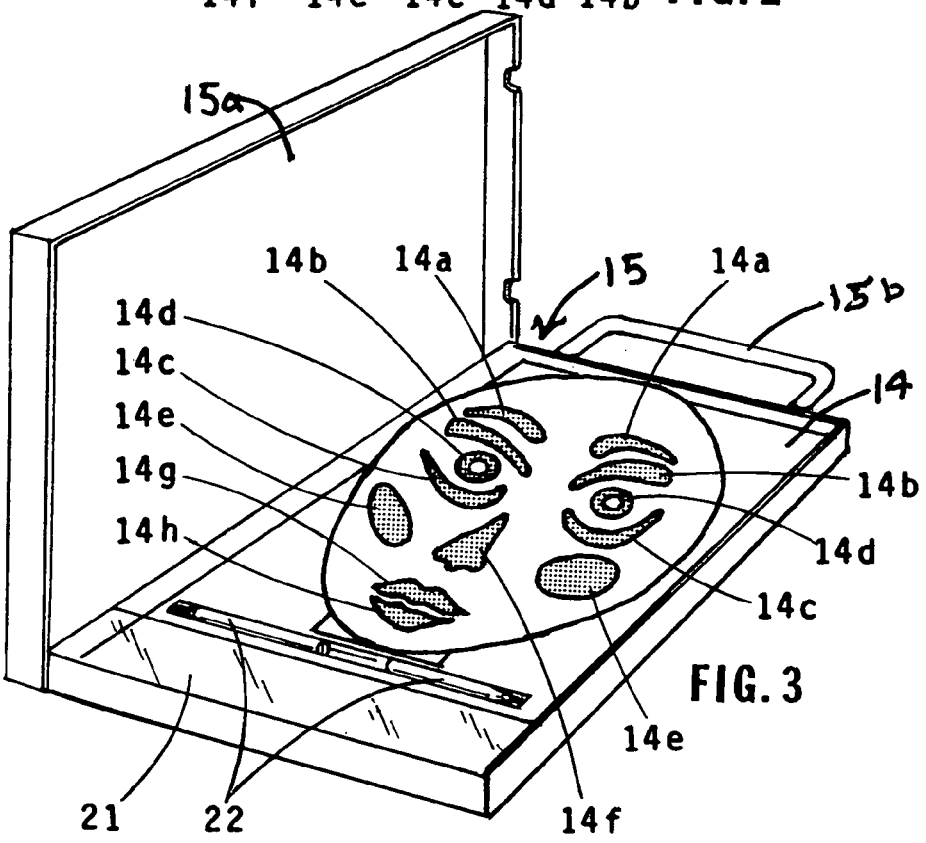
FIG. 3 is a front perspective view of the first embodiment.

Referring to FIGS. 1–3, a first embodiment of the invention is illustrated. The kit has an inner backing portion 14 formed of metal, plastic, or other suitable material. Attached to the backing portion 14 or formed therein are cosmetic receptacles shaped to represent a nose 14*f* (containing pressed powder), upper and lower lips 14*g* and 14*h* (containing lip product), cheeks 14*e* (containing blush/rouge), eye brows 14*a* (containing brow/eye shadows), upper eyelids 14*b* (containing eye shadows) and lower eyelids 14*c* (containing concealer), and the eye area, specifically the eyeballs 14*d* (containing eye shadow) to be placed above the eyes. A designated cosmetic specified for a particular part of the face is stored in each receptacle. The face shaped kit containing receptacles in the shapes of facial features may be fabricated of a suitable plastic, metal, or other material. In lieu of cosmetics, other suitable coloring material may be utilized A carrying case 15 having a top cover 15*a* and a carrying handle 15*b* is utilized for packaging the device of the invention. Also, a frame like border 23 that runs upwardly from the backing portion 14 and surrounds the face design containing makeup serves as part of the kit. A mirror 21 and a container for cosmetic applicators 22 are provided in the bottom portion of the case. The top cover 15*a* is transparent so that the inner portions of the case are visible when the cover is closed.

Figure 4:
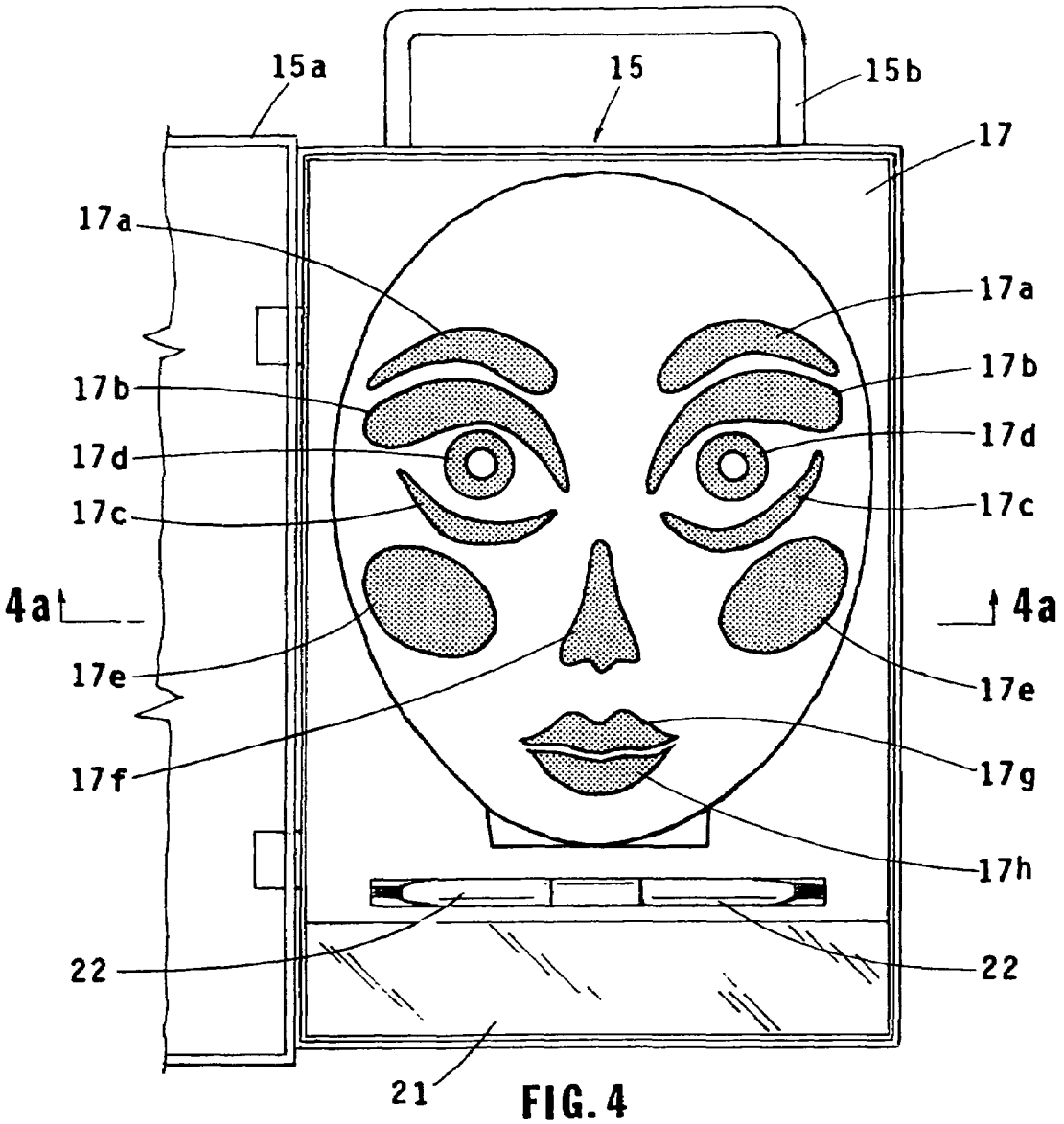
FIG. 4 is a front plan view of a second embodiment of the invention.
Figure 4A:
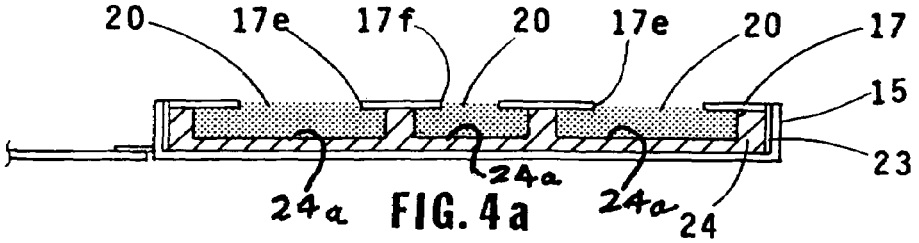
FIG. 4A is a cross-sectional view along the plane indicated by 4A—4A in FIG. 4.
Figure 5:
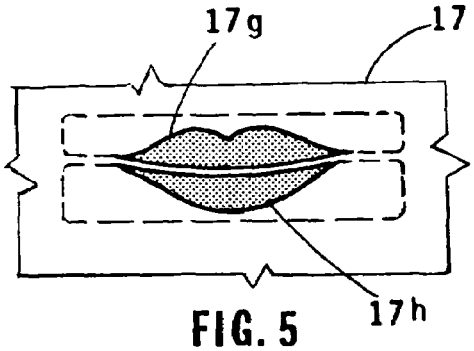
FIG. 5 is a top plan view of the lip portion of the face of the second embodiment.
Figure 6:
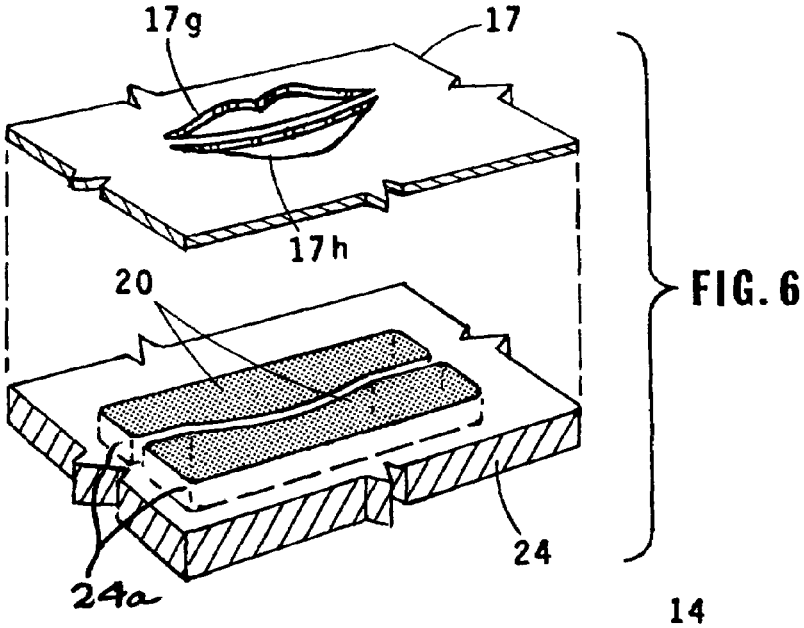
FIG. 6 is an exploded view of the lip portion of the embodiment of FIG. 5 showing the lip openings in the mask and the receptacles containing the cosmetic for the lips.

Referring now to FIGS. 4–6, a second embodiment of the invention is illustrated. The second embodiment has a backing portion 24 with the receptacles 24*a* formed in the backing portion or attached thereto. In this second embodiment, receptacles 24*a* are not in the shapes of the face portions. The receptacles are arranged, however, so that they are in positions beneath the portions of the face for which they carry cosmetic products 20. The images for the various face portions are designed in the form of a mask 17 containing cut out shapes mimicking parts of the face including the eyebrows 17*a*, the upper and lower eyelids 17*b* and 17*c*, the eyes 17*d*, the cheeks 17*e*, the nose 17*f* and the lips 17*g* and 17*h*. The mask like images lie on top of the cosmetic receptacles which may be fabricated of a sheet of durable paper, plastic, metal or other suitable material with a receptacle placed beneath each face portion formed in the mask.

Referring to FIGS. 5 and 6, by example, the lip portion of the facial image is illustrated. Apertures 17*g* and 17*h* are in the configuration of the lip portion of the face to which the cosmetics 20 in the receptacles 24*a* formed in the backing portion 24 are to be applied.

Figure 7:
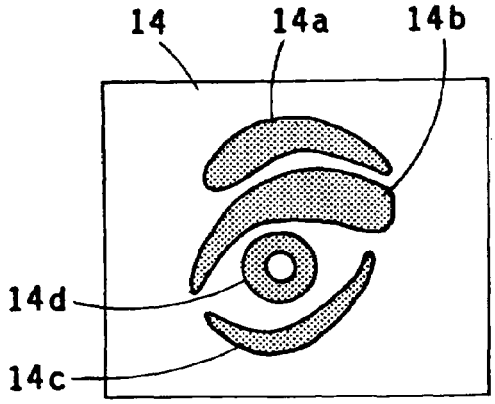
FIG. 7 is a top plan view of a third embodiment of the invention.

Referring now to FIG. 7, a further embodiment of the invention is illustrated. This embodiment is similar in its basic configuration to the first embodiment. In this embodiment, the kit contains only the eye portions with receptacles 14*a*–14*d* respectively being shaped like the eye, the eyebrows, and the upper and lower eyelids. Each of these receptacles contains makeup material suitable for the portions of the area of the eye which they pictorially represent. It is to be noted that the eyeball receptacles 14*d* contain cosmetic to be placed above the eyes and not in the eyes . . .

Similarly, separate kits could be provided for the cheeks, lips and nose, each such kit having only a single receptacle in the shape of the portion of the face they represent with the proper makeup material contained therein.

Consumers use the kit as a guide when applying makeup. The eye shadow is provided in the eye portion area of the kit. The eye shadow contained in the kit is meant to be applied to the same area on the individual as is displayed in the kit; the idea being that when the users look at their kits, it is as though they are looking at their own face reflection in a mirror.

For those who are well experienced or have a natural knack with make up application, the device of this invention is still useful by providing the necessary make up requirements; i.e. all inclusive color cosmetics and make up application tools within an aesthetically appealing compact container. However, as practical and functional this kit may be, it may also serve some as a clever attractive item as well.

The kits can be fabricated so that the cosmetics can be replenished when they are used up. This can be done with replacement filled pans of make up which can be magnetically attached to the inner surface of the kit by means of transparent portions which may be magnetic. Another option is to employ pressed powder in the nose receptacle. Other variations in the cosmetic or coloring may be employed as may be required by the user.

While the invention has been described and illustrated in detail, it is to be clearly understood that this is by way of illustration and example only and is not intended by way of limitation, the coverage of this invention being limited only by the terms of the following claims.

I claim:

1. A makeup kit comprising: a a backing portion on the inside of said kit having a plurality of receptacles thereon, wherein each of said receptacles being positioned and shaped to provide a pictorial image of a different portion of a human face;

a mask having cutout portions, each of said cutout portions pictorially representing a different portion of a human face, and a cosmetic material contained in each of said receptacles for each of said different portions of a human face;

said cutout portions of said mask being positioned so that each of said cutout portions overlies each of said receptacles which carries the cosmetic for a corresponding portion of the human face.

2. The makeup kit of claim 1 wherein said kit is contained in a carrying case.

3. The makeup kit of claim 1 and further including a receptacle formed in said kit for storing cosmetic applicators.

4. The makeup kit of claim 1 and further including a mirror in said kit.

* * * * *